United States Patent [19]

Kim

[11] Patent Number: 4,960,385

[45] Date of Patent: Oct. 2, 1990

[54] CATHODE-RAY TUBE SOCKET

[75] Inventor: Won-Tae Kim, Daegu, Rep. of Korea

[73] Assignee: Goldstar Co., Ltd., Seoul, Rep. of Korea

[21] Appl. No.: 273,619

[22] Filed: Nov. 17, 1988

Related U.S. Application Data

[63] Continuation of Ser. No. 46,684, May 17, 1988, abandoned.

[30] Foreign Application Priority Data

May 9, 1986 [KR] Rep. of Korea ..... 86-6318[U]

[51] Int. Cl.[5] ..... H01R 13/53

[52] U.S. Cl. ..... 439/182; 439/890; 362/318

[58] Field of Search ..... 439/168, 182, 220, 280, 439/336, 356, 375, 414, 521, 541, 602, 605, 684, 721, 722, 723, 733, 890; 362/313, 318, 325

[56] References Cited

U.S. PATENT DOCUMENTS

| | | | |
|---|---|---|---|
| 3,240,980 | 3/1966 | Schuster | 313/318 |
| 3,377,612 | 4/1968 | Klier et al. | 313/318 |
| 3,636,412 | 1/1972 | Simovits et al. | 313/325 |
| 4,573,755 | 3/1986 | Simovits | 439/182 |
| 4,649,315 | 3/1987 | Inaba et al. | 313/325 |

FOREIGN PATENT DOCUMENTS

| | | | |
|---|---|---|---|
| 1563586 | 8/1970 | Fed. Rep. of Germany | 439/733 |

*Primary Examiner*—David Pirlot

[57] ABSTRACT

A cathode-ray tube socket comprising a terminal board including a plurality of radial grooves and a circular groove disposed at the middle portion of the radial grooves and cutting across the radial grooves, the circular groove having a plurality of projecting members and a cap cover for assembling with the terminal board and an electric ground terminal inserted into the terminal board and cap cover has a plurality of opening and spark arresting members so that, after assembly, the electric ground terminal is engaged in the circular groove for effectively protecting the overvoltage.

3 Claims, 2 Drawing Sheets

CATHODE-RAY TUBE SOCKET

This application is a continuation of application Ser. No. 046,684 filed on May 17, 1988, now abandoned.

BACKGROUND OF THE INVENTION

The present invention relates to a cathode-ray tube socket having spark gaps incorporated therein.

In the conventional art, an air gap discharger of a cathode-ray tube socket is formed in such a way that an electrode element is placed through a guadrangular base made of a flame-resisting resin and is cut in the middle within a base to form gaps. However, the cutting of the electrode element is not easy to be made in a small space; besides, making minor gaps on a plane also is not easy and often results in many inferior products.

Therefore, to remove such shortcoming of the conventional socket, the present invention provides a construction for the socket in that a terminal board is provided with connector-receiving grooves formed and defined by thick walls in-between, across the middle of which is cut a deep groove of a ring shape to receive a common earth terminal having small openings and bent-members in integrity, the openings being arranged to receive projections provided at the bottom of the earth terminal groove and the connector grooves receiving connectors and being capped by a cover for the connectors to be set firmly by the pressure of convexities provided at the bottom of the cap over. This construction presents an easiness and convenience for production of the socket.

According to the present invention, the quadrangular base of a flame-resisting synthetic resin used for the conventional socket may be eliminated to obtain a simple construction having a common earth terminal, which is simply machineworked to provide small gaps.

DETAILED DESCRIPTION OF THE INVENTION

In reference to the present accompanying drawings, the invention shall be described in detail, as follows.

Figure 1:
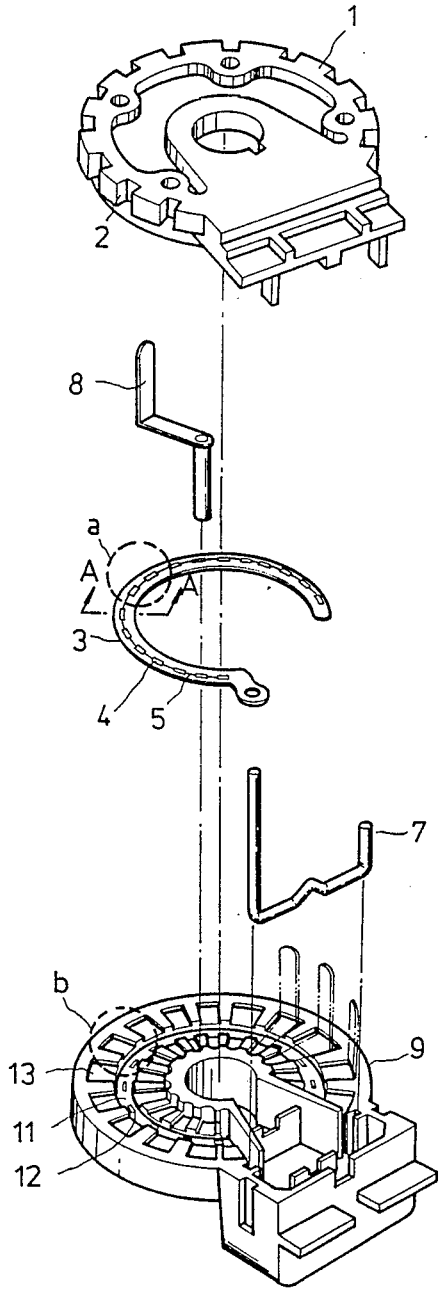
FIG. 1 shows an exploded, perspective view, cathode-ray tube socket of the present invention.

As shown in FIG. 1, a cathode-ray socket of the present invention comprises a terminal board 9, a cap cover 1, a common earth terminal 3 for forming spark gaps, connectors 8 for forming circuits, and a guide pin 7. The terminal board 9 is provided at its face with a plurality of connector-receiving grooves 13 radially defined by thick walls 10 formed between the grooves 13. The thick walls 10 are cut across in the middle to form an earth-terminal-receiving ring-groove 11 which is cut deeper than the grooves 13 a cathode-ray tube socket of the present invention at its bottom a plurarity of small projections 12 to fit into the earth terminal 3.

The earth terminal 3 provides overvoltage protection and is formed in a shape of a circular arc band having a plurarity of openings 4 and bends 5 disposed between the openings 4. The connectors 8 are formed in a shape "ㄴ" and have pin holes respectively to receive the pin of the cathode-ray tube.

Figure 2:
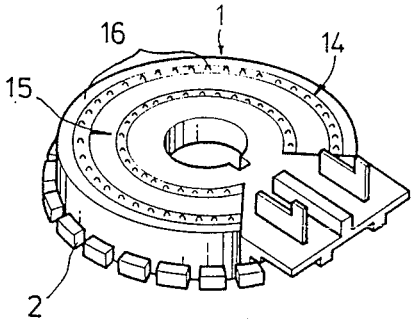
FIG. 2 shows a perspective view of the cap of a cathode-ray tube socket of the present invention.

As shown in FIG. 2, the cap cover 1 is provided, for receiving the connectors 8 with recesses 2 on its circumference and with outer and inner ring projections 14 and 15 having small convexities 16 disposed at the bottom side thereof (FIG. 2).

Figure 3:
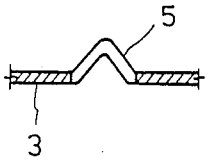
FIG. 3 shows a section A—A of the earth terminal in FIG. 1 taken along line A—A.

As shown in FIG. 3, the earth terminal band 3 is provided with the openings 4 of a size large enough to receive projections 12 formed at the bottom of the earth-terminal-receiving groove 11 in the terminal board 9 and is also provided with bends 5 of a shape "∧" so as to form the spark gaps when in place under the connectors 8.

Figure 4:
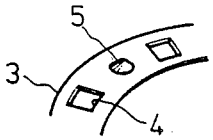
FIGS. 4A and 4B show an enlarged detail view of the part (a) of FIG. 1.

The opening 4 disposed between the bends 5 in the earth terminal 3 is formed into a shape as shown in FIG. 4A or formed into as shape as shown in FIG. 4B for convenient machine work.

Figure 5:
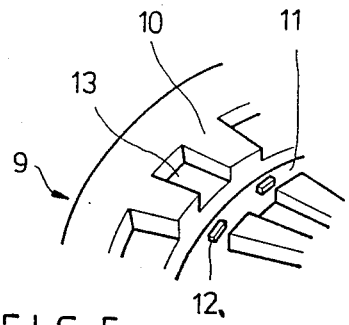
FIG. 5 shows an enlarged detail view of the part (b) of FIG. 1.
Figure 6:
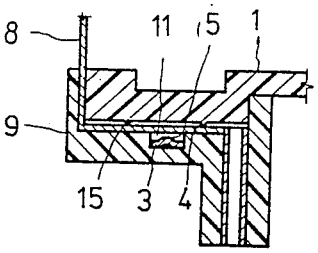
FIG. 6 shows a sectional view of a cathode-ray tube socket of the present invention.
Figure 7:
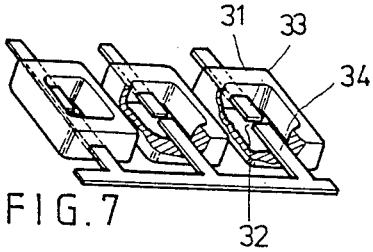

As shown in FIG. 5 showing an enlarged detail view of the portion (b) of the terminal board 9 of FIG. 1, the board 9 is provided with a plurarity of connector-receiving grooves 13 to form thick walls 10 between grooves 13. The thick walls 10 are cut across in the middle to form a ring-shaped groove 11 being deeper than the connector grooves 13 in the depth. The ring-groove 11 is provided at its bottom a plurality of projections 12 to set in place the earth terminal 3 with the openings 4 for receiving the projections 12 to keep the terminal 3 secured.

According to the present invention, the socket is constructed in such a way that the terminal board 9 receives in its groove 11 the earth terminal 3 to be fastened by the guide pin 7 also receives a connector 8 in each of the grooves 13 to be capped by the cover 1.

In the assembling, the earth terminal band 3 is firmly set in the groove 11 of the board 9 by means of projections 12 being arranged to be received through openings 4, and the connectors 8 are placed in the radial grooves 13 to form the spark gaps between the bends 5 of the earth terminal 3 and the connectors 8 which are set in place under the pressure of the ring projections 14 and 15 of the cap 1.

As described, the present invention having the earth terminal 3 and the connectors 8 both mounted on the terminal board 9 is designed to cause discharge at the gap between the bend 5 of the terminal 3 and the connector to prevent any excessive current on channels.

The effects of the present construction are that the earth terminal construction is simplified by making openings and bends in integrity of the terminal; that the projections in the earth-terminal-receiving groove 11 of the terminal board 9 and the ring projections 14 and 15 of the cap 1 firmly keep in place the earth terminal band and connectors in the assembly that the simplified and stabled construction of the cathode-ray tube socket with simplified components reduces the number of inferior products in assembling and enhances the quality and reliability of the products.

What is claimed is:

1. A cathode-ray tube socket comprising:

a terminal board including a plurality of radially extending grooves disposed therein, said terminal board further including a circular groove being deeper within the terminal board than said grooves and being provided with a plurality of first projecting members;

a cap cover for covering said terminal board, said cap cover including an outer ring and an inner ring disposed in a bottom portion thereof, and a plurality of recesses disposed in a circumferential portion thereof;

an electrical ground member disposed between said terminal board and said cap cover, said electrical ground member including a plurality of spark gaps arresting members; and electrical connecting means, disposed within and between both said terminal board and said cap cover, for providing an elctrical path through the cathode-ray tube socket, whereby the cathode-ray tube socket provides effective overvoltage protection;

said outer ring including a plurality of second projecting members;

said inner ring including a plurality of third projecting members;

said outer and inner rings pressing said electrical connecting means into said radially extending grooves;

said electrical ground member further including a plurality of fourth projecting members disposed between said plurality of spark gaps, said plurality of fourth projecting members pressing said electrical ground member against said terminal board, thereby maintaining said spark gaps arresting members positioned around said first projecting members.

2. The cathode-ray tube socket as claimed in claim 1, wherein a bottom portion of said radially extending grooves have a height with respect to a bottom portion of said circular groove higher than a height of said first projecting members.

3. The cathode-ray tube socket as claimed in claim 1, wherein said fourth projecting members are formed in a hemispherical shape.

* * * * *